US009286846B2

(12) United States Patent
Yu et al.

(10) Patent No.: US 9,286,846 B2
(45) Date of Patent: Mar. 15, 2016

(54) LIQUID CRYSTAL DISPLAY AND BIDIRECTIONAL SHIFT REGISTER APPARATUS THEREOF

(71) Applicant: Hannstar Display Corporation, New Taipei (TW)

(72) Inventors: Chia-Hua Yu, New Taipei (TW); Sung-Chun Lin, Tainan (TW); Hsuan-Chen Liu, Kaohsiung (TW); Chien-Ting Chan, Tainan (TW)

(73) Assignee: HannStar Display Corporation, New Taipei (TW)

( * ) Notice: Subject to any disclaimer, the term of this patent is extended or adjusted under 35 U.S.C. 154(b) by 62 days.

(21) Appl. No.: 14/181,746

(22) Filed: Feb. 17, 2014

(65) Prior Publication Data

US 2015/0102991 A1 Apr. 16, 2015

(30) Foreign Application Priority Data

Oct. 16, 2013 (CN) ..... 2013 1 0485086

(51) Int. Cl.
*G09G 3/36* (2006.01)

(52) U.S. Cl.
CPC ..... *G09G 3/3648* (2013.01); *G09G 2310/0267* (2013.01); *G09G 2310/0283* (2013.01); *G09G 2310/0286* (2013.01)

(58) Field of Classification Search
CPC ..... G09G 2310/0286
USPC ..... 345/100; 377/64–81
See application file for complete search history.

(56) References Cited

U.S. PATENT DOCUMENTS

| | | | | |
|---|---|---|---|---|
| 8,803,784 | B2 * | 8/2014 | Sakamoto | G09G 3/3677 345/100 |
| 2008/0012818 | A1 * | 1/2008 | Lee | G09G 3/3677 345/100 |
| 2012/0242630 | A1 * | 9/2012 | Ohara | G09G 3/3677 345/204 |

* cited by examiner

*Primary Examiner* — Roy Rabindranath
(74) *Attorney, Agent, or Firm* — Jianq Chyun IP Office

(57) ABSTRACT

An LCD and bidirectional shift register apparatuses thereof are provided. One of the bidirectional shift register apparatuses includes $N^{th}$ shift registers. An $i^{th}$ shift register includes a pre-charge unit, a pull-up unit and a pull-down unit. When i is greater than or equal to 3 and less than or equal to N−2, the pre-charge unit receives outputs of an $(i-2)^{th}$ and an $(i+2)^{th}$ shift register. When i is equal to 1 or 2, the pre-charge unit receives a first start pulse signal and the output of the $(i+2)^{th}$ shift register. When i is equal to (N−1) or N, the pre-charge unit receives a second start pulse signal and the output of the $(i-2)^{th}$ shift register. The pre-charge unit outputs a pre-charge signal. The pull-up unit outputs a scan signal. The pull-down unit receives the pre-charge signal to control a level of the scan signal.

10 Claims, 9 Drawing Sheets

LIQUID CRYSTAL DISPLAY AND BIDIRECTIONAL SHIFT REGISTER APPARATUS THEREOF

CROSS-REFERENCE TO RELATED APPLICATION

This application claims the priority benefit of China application serial no. 201310485086.7, filed on Oct. 16, 2013. The entirety of the above-mentioned patent application is hereby incorporated by reference herein and made a part of this specification.

BACKGROUND

1. Field of the Invention

The invention is directed to a flat panel display (FPD) technique and more particularly, to a liquid crystal display (LCD) and bidirectional shift register apparatuses thereof.

2. Description of Related Art

In recent years, with the vigorous development in semiconductor technologies, portable electronic products and flat panel display (FPD) products have become popular. Among various types of flat displays, liquid crystal displays (LCD) have become the main stream products due to advantages such as having low voltage operation, no radiation, light weight and small size. Accordingly, the LCDs developed by various manufacturers trend to be miniaturization and low cost.

In order to reduce the fabrication cost of LCDs, in replacement of disposing shift registers of a scan driver IC on a scan side of an LCD panel, some manufacturers have developed to directly dispose the shift registers of the scan driver IC on a glass substrate of the LCD panel under a condition where an LCD panel is fabricated by adopting an amorphous silicon (a-Si) process. Hence, the scan driver IC originally disposed on the scan side of the LCD panel can be omitted so as to achieve the reduction of the fabrication cost.

SUMMARY

The invention is directed to a liquid crystal display and bidirectional shift register apparatuses thereof, which can prevent shift registers from abnormal operating due to a stress effect occurring in semiconductor devices so as to improve reliability of the bidirectional shift register apparatus.

The invention provides a bidirectional shift register apparatus including N shift registers, connected in series, and an $i^{th}$ shift register of the N shift registers includes a pre-charge unit, a pull-up unit and a pull-down unit. When i is greater than or equal to 3 and less than or equal to N−2, the pre-charge unit receives outputs of an $(i-2)^{th}$ and an $(i+2)^{th}$ shift registers to output a pre-charge signal. Therein, N is a predetermined positive integer. When i is equal to 1 or 2, the pre-charge unit receives a first start pulse signal and the output of the $(i+2)^{th}$ shift register to output the pre-charge signal. When i is equal to (N−1) or N, the pre-charge unit receives a second start pulse signal and the output of the $(i-2)^{th}$ shift register to output the pre-charge signal. The pull-up unit is coupled to the pre-charge unit and receives the pre-charge signal and a predetermined clock signal to output a scan signal. The pull-down unit is coupled to the pre-charge unit and the pull-up unit and receives the pre-charge signal, a first level signal and a second level signal to control a level of the scan signal.

The invention provides an LCD including an LCD panel, a driving circuit and a backlight module. The LCD panel a substrate, a plurality of pixels arranged in an array, a first bidirectional shift register apparatus and a second bidirectional shift register apparatus. The pixels the first bidirectional shift register apparatus and the second bidirectional shift register apparatus are disposed on the substrate. The first bidirectional shift register apparatus has N first shift registers connected in series and respectively corresponding to the pixels arranged in odd-numbered columns, and an $i^{th}$ first shift register of the N first shift registers includes a first pre-charge unit, a first pull-up unit and a first pull-down unit. When i is greater than or equal to 3 and less than or equal to N−2, the first pre-charge unit receive outputs of an $(i-2)^{th}$ and an $(i+2)^{th}$ first shift registers to output a first pre-charge signal. Therein, N is a predetermined positive integer. When i is equal to 1 or 2, the first pre-charge unit receives first start pulse signal receives a first start pulse signal and the output of the $(i+2)^{th}$ first shift register to output the first pre-charge signal. When i is equal to (N−1) or N, the first pre-charge unit receives a second start pulse signal and the output of the $(i-2)^{th}$ first shift register to output the first pre-charge signal. The first pull-up unit is coupled to the first pre-charge unit and receives the first pre-charge signal and a first predetermined clock signal to output a first scan signal. The first pull-down unit is coupled to the first pre-charge unit and the first pull-up unit and receives the first pre-charge signal, a first level signal and a second level signal to control a level of the first scan signal. The second bidirectional shift register apparatus has M second shift registers connected in series and respectively corresponding to the pixels arranged in even-numbered columns, and an $j^{th}$ second shift register of the M second shift registers includes a second pre-charge unit, a second pull-up unit and a second pull-down unit. When j is a positive integer which is greater than or equal to 3 and less than or equal to M−2, the second pre-charge unit receives outputs of an $(j-2)^{th}$ and an $(j+2)^{th}$ second shift registers so as to output a second pre-charge signal. Therein, M is a predetermined positive integer. When j is equal to 1 or 2, the second pre-charge unit receives a third start pulse signal and the output of the $(j+2)^{th}$ second shift register to output the second pre-charge signal. When j is equal to (M−1) or M, the second pre-charge unit receives a fourth start pulse signal and the output of the $(j-2)^{th}$ second shift register to output the second pre-charge signal. The second pull-up unit is coupled to the second pre-charge unit and receives the second pre-charge signal and a second predetermined clock signal to output a second scan signal. The second pull-down unit is coupled to the second pre-charge unit and the second pull-up unit and receives the second pre-charge signal, a third level signal and a fourth level signal to control a level of the second scan signal. The driving circuit coupled to the LCD panel, configured to drive the LCD panel to display an image and provides a plurality of predetermined clock signals to serve as the first predetermined clock signal and the second predetermined clock signal The backlight module configured to provide a light source for the LCD panel.

To sum up, the invention provides an LCD and bidirectional shift register apparatuses thereof capable of omitting the disposition of dummy shift registers in the bidirectional shift register apparatus, such that the issue that the transistors of the dummy shift registers are easily affected due to the stress effect occurring from the transistors being constantly turned on and off can be prevented. Thereby, the reliability of the bidirectional shift register apparatuses can be further advanced.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
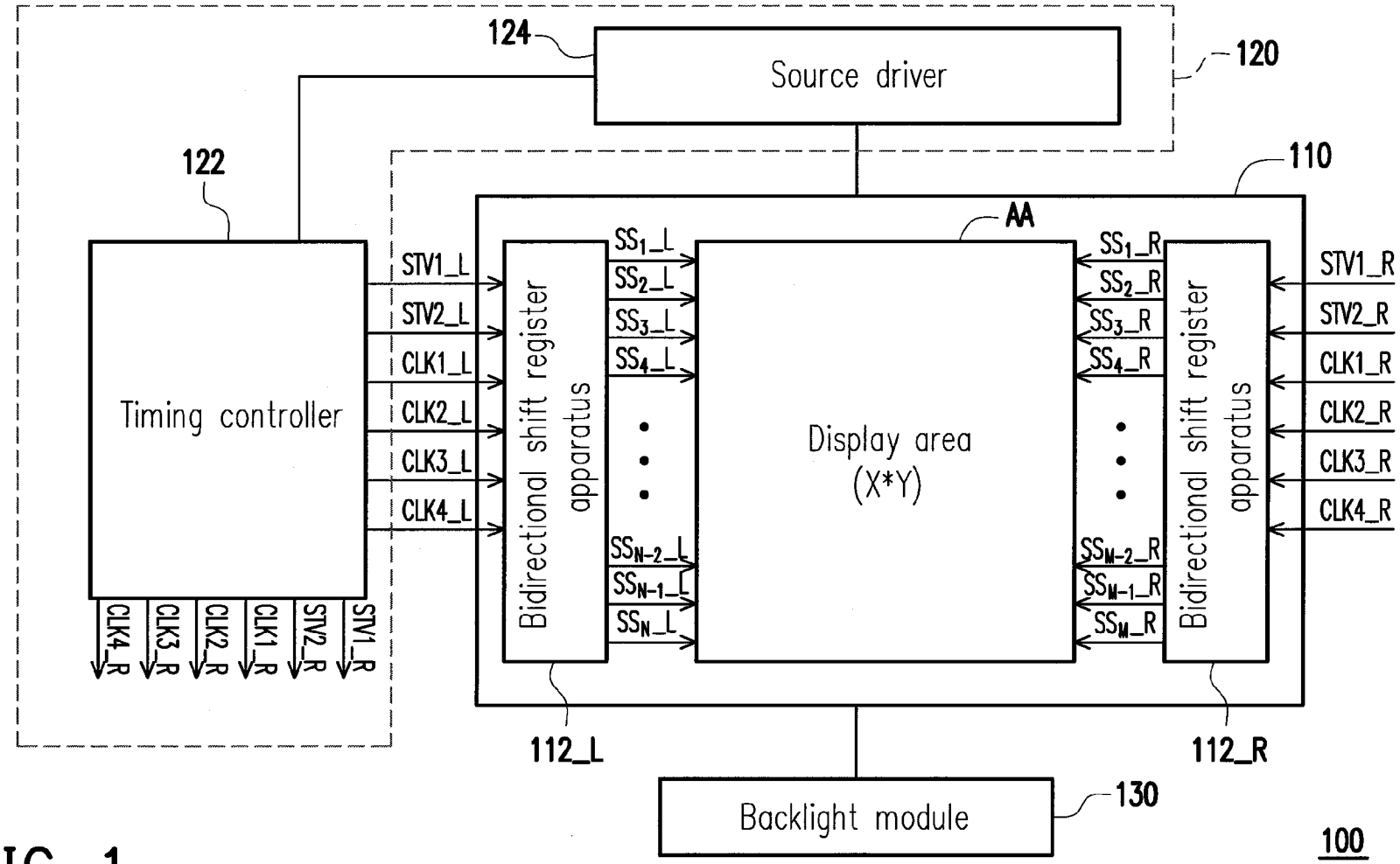
FIG. 1 is a schematic diagram of a liquid crystal display (LCD) according to an embodiment of the invention.

Reference will now be made in detail to the exemplary embodiments of the invention, examples of which are illustrated in the accompanying drawings. Wherever possible, the same reference numbers are used in the drawings and the description to refer to the same or like parts.

FIG. 1 is a schematic diagram of a liquid crystal display (LCD) according to an embodiment of the invention. Referring to FIG. 1, an LCD 100 includes an LCD panel 110, a driving circuit 120 and a backlight module 130 configured to provide a light (or a backlight) source required by the LCD panel 110.

The LCD panel 110 includes a substrate (which is not shown and may be, for example, a glass substrate), a display area AA and bidirectional shift register apparatuses 112_L and 112_R. In the present exemplary embodiment, there is a plurality of pixels (of which the number is represented by X*Y, where both X and Y are positive integers) arranged in an array in the display area AA of the LCD panel 110. Generally, X*Y may also represent display resolution of the LCD 110, such as 1024*768, which is not limited in the invention. The bidirectional shift register apparatuses 112_L and 112_R are directly disposed on two sides of the substrate of the LCD panel 110 and coupled to the pixels in odd and even rows through corresponding scan lines, respectively.

The driving circuit 120 includes a timing controller 122 and a source driver 124. In the driving circuit 120, the timing controller 120 may provide a plurality of predetermined clock signals (e.g., STV1_L, STV2_L, STV1_R, STV2_R, CLK1_L through CLK4_L and CLK1_R through CLK4_R) to control operations of the bidirectional shift register apparatuses 112_L and 112_R. Moreover, the source driver 124 is also controlled by the timing controller 122 to output a plurality of primitive voltages to drive the corresponding pixels in the LCD panel 110.

To be more detailed, the bidirectional shift register apparatus 112_L is controlled by the timing controller 122 and outputs a plurality of scan signals SS1_L through SSN_L in response to the start pulse signals STV1_L and STV2_L and the clock signals CLK1_L through CLK4_L provided by the timing controller 122. It should be mentioned that in the present exemplary embodiment, the scan signals SS1_L through SSN_L are provided to the pixels arranged in odd-numbered columns of the LCD panel 110 to sequentially turn on the pixels arranged in odd-numbered columns. In this case, N is a positive integer corresponding and equal to a column number of the pixels arranged in odd-numbered columns. Thus, all of the scan signals SS1_L through SSN_L output by the bidirectional shift register apparatus 112_L serve to turn on the pixels arranged in odd-numbered columns of the display area AA, and namely, the bidirectional shift register apparatus 112_L neither have nor have to be disposed with any dummy shift register.

Similarly, the bidirectional shift register apparatus 112_R outputs a plurality of scan signals SS1_R through SSM_R in response to the start pulse signals STV1_R and STV2_R and the clock signals CLK1_R through CLK4_R provided by the timing controller 122. In the present exemplary embodiment, the scan signals SS1_R through SSM_R are provided to the pixels arranged in even-numbered columns of the LCD panel 110 to sequentially turn on the pixels arranged in even-numbered columns. In this case, M is a positive integer corresponding and equal to a column number of the pixels arranged in even-numbered columns. Thus, all of the scan signals SS1_R through SSM_R output by the bidirectional shift register apparatus 112_R serve to turn on the pixels arranged in even-numbered columns of the display area AA, the bidirectional shift register apparatus 112_R neither have nor have to be disposed with any dummy shift register.

According to the aforementioned driving manners, the pixels in each column of the LCD panel 110 are sequentially turned on according the corresponding scan signals SS1_L through SSN_L and $SS_1$_R through $SS_M$_R. In the present exemplary embodiment, the timing controller 122 may control the scan order of the bidirectional shift register apparatuses 112_L and 112_R by providing different predetermined clock signals, such that the bidirectional shift register apparatuses 112_L and 112_R may sequentially turn on the pixels in each column of display area AA according to a scanning order along a forward direction (i.e., form the first column to the last column) or along a backward direction (i.e., form the last column to the first column).

Figure 2A:
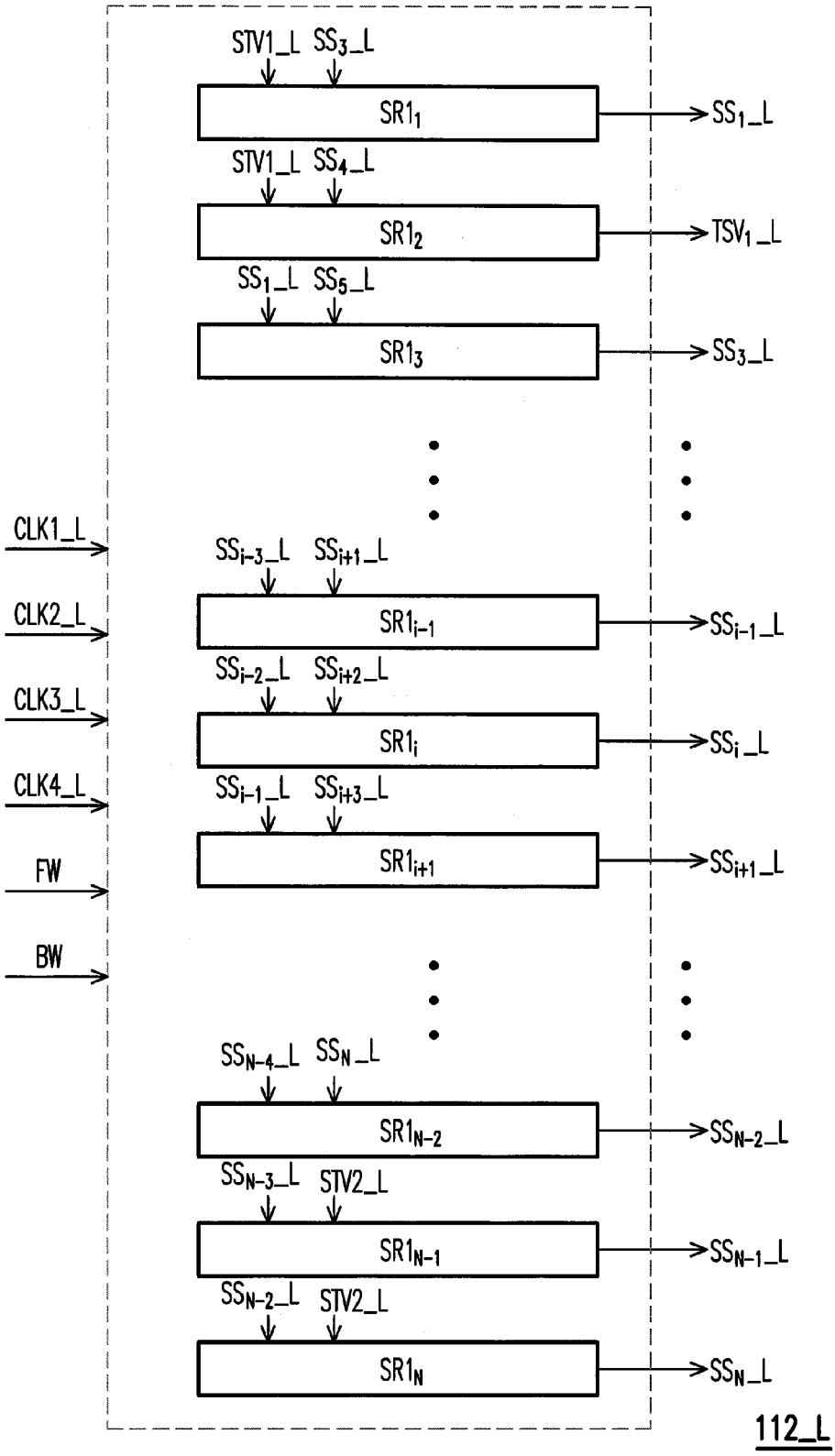
FIGS. 2A and 2B are schematic diagrams of the bidirectional shift register apparatuses of the embodiment illustrated in FIG. 1.
Figure 2B:
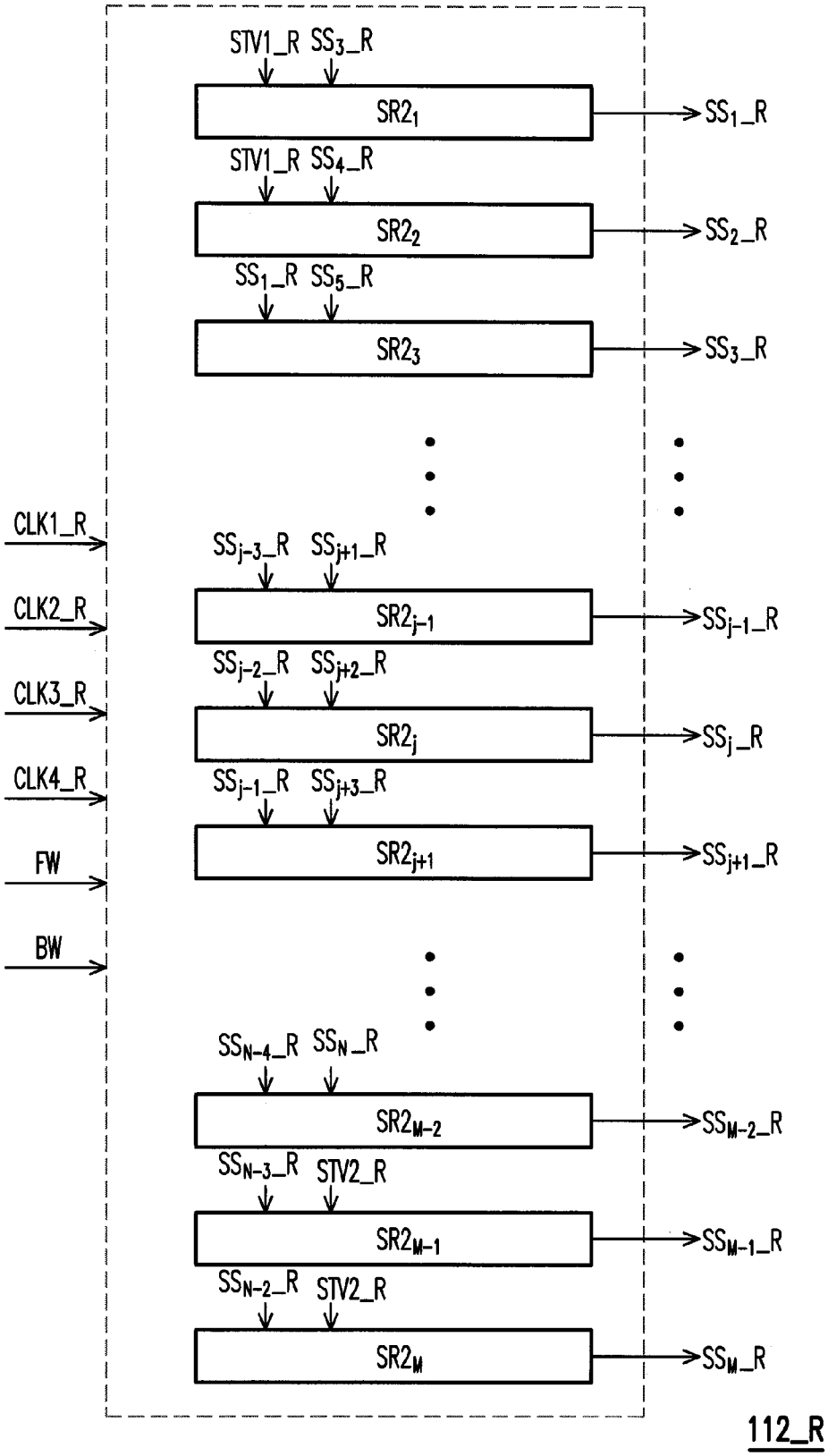

To be clearer, FIGS. 2A and 2B are schematic diagrams of the bidirectional shift register apparatuses 112_L and 112_R. First, referring to FIG. 2A, the bidirectional shift register apparatus 112_L includes N shift registers $SR1_1$ through $SR1_N$ which are substantially the same and connected in series. Based on the above, the bidirectional shift register apparatus 112_L of the invention does not have any dummy shift register. Accordingly, scan signals $SS_1$_L, $SS_2$_L, $SS_{N-1}$_L and $SS_N$_L respectively output by a first, a second, an $(N-1)^{th}$ and an $N^{th}$ shift registers $SR1_1$, $SR1_2$, $SR1_{N-1}$ and $SR1_N$ serve to turn on the pixels in the display area AA in the same way. That is to say, the scan signals $SS_1$_L, $SS_2$_L, $SS_{N-1}$_L and $SS_N$_L respectively output by the first, the second, the $(N-1)^{th}$ add the $N^{th}$ shift register $SR1_1$, $SR1_2$, $SR1_{N-1}$ and $SR1_N$ sequentially turn on the corresponding pixels arranged in odd-numbered columns through the corresponding scan lines. On the other hand, outputs $SS_3$_L through $SS_{N-2}$_L of a third shift register $SR1_3$ through a $(N-2)^{th}$ shift register $SR1_{N-2}$ sequentially turn on the corresponding pixels arranged in odd-numbered columns through the corresponding scan lines.

Similarly, referring to FIG. 2B, the bidirectional shift register apparatus 112_R includes M shift registers $SR2_1$ through $SR2_M$ which are substantially the same and connected in series. Scan signals $SS_1$_R, $SS_2$_R, $SS_{M-1}$_R and $SS_M$_R respectively output by a first, a second, an $(M-1)^{th}$ and an $M^{th}$ shift registers $SR2_1$, $SR2_2$, $SR2_{M-1}$ and $SR2_M$ sequentially turn on the corresponding pixels arranged in even-numbered columns through the corresponding scan lines. On the other hand, outputs $SS_3$_R through $SS_{M-2}$_R of a third shift register $SR2_3$ through a $(M-2)^{th}$ shift register $SR2_{M-2}$ sequentially turn on the corresponding pixels arranged in even-numbered columns through the corresponding scan lines.

In the present exemplary embodiment, the bidirectional shift register apparatuses 112_L and 112_R may sequentially output the scan signals SS1_L through SSN_L and $SS_1$_R through $SS_M$_R in the forward direction or the backward direction according to a forward input signal FW or a backward input signal BW. The forward input signal FW and the backward input signal BW may be provided by the timing controller 122 or an additional signal generation unit, which is not limited in the invention.

In the below descriptions of the exemplary embodiments of the invention, since each of the shift registers $SR1_1$ through $SR1_N$ and $SR2_1$ through $SR2_M$ have substantially the same operational principles and circuit structures, an $i^{th}$ shift register SR1*i* of the bidirectional shift register apparatus 112_L is illustrated as an example. Persons of skills in the art can likewise derive operational principles and circuit structures of the bidirectional shift register apparatus 112_R and each of the shift registers $SR2_1$ through $SR2_M$ from the below descriptions directly without discrepancy. Thus, in the below exemplary embodiments, only the difference between bidirectional shift register apparatus 112_R and the bidirectional shift register apparatus 112_L will be described, and no repeated description will be made.

Figure 3:
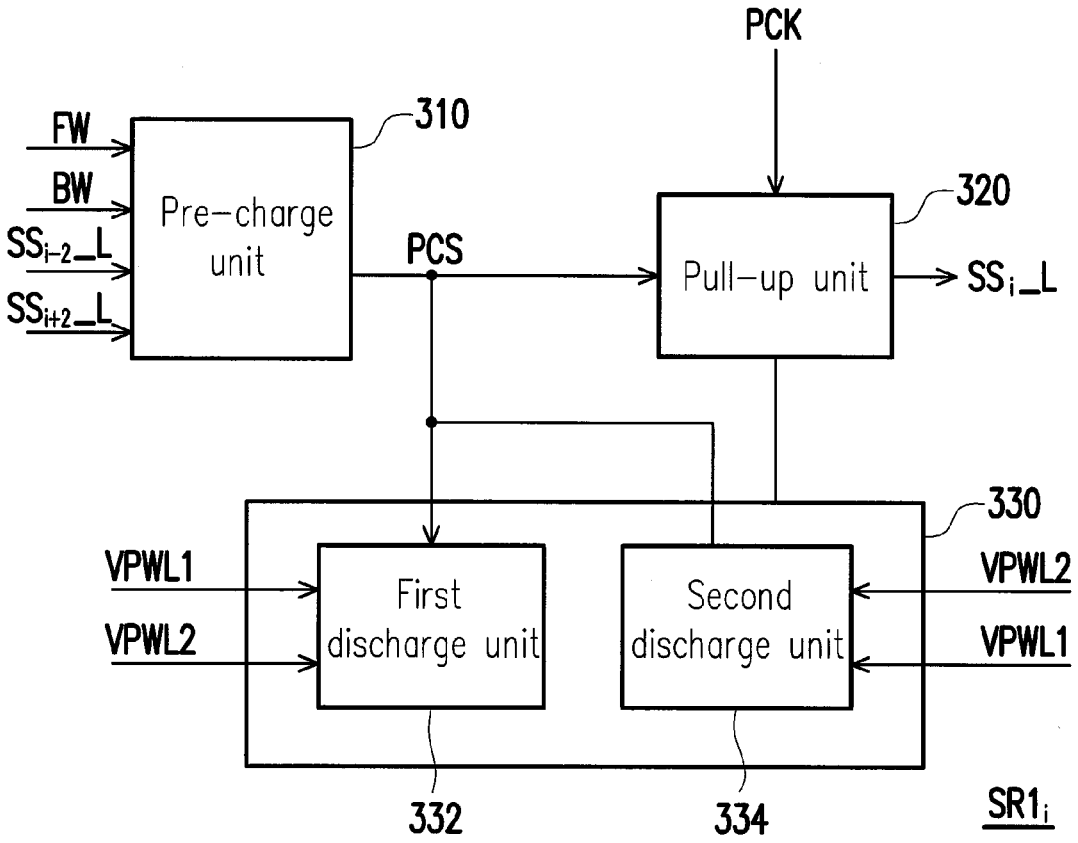
FIG. 3 is a schematic diagram of the shift registers of the embodiment illustrated in FIG. 2A.

FIG. 3 is a schematic diagram of the shift registers of the embodiment illustrated in FIG. 2A. Referring to both FIG. 2A and FIG. 3, the $i^{th}$ shift register $SR1_i$ includes a pre-charge unit 310, a pull-up unit 320 and a pull-down unit 330. It should be specially mentioned that the pre-charge unit 310 receives outputs of an $(i-2)^{th}$ and an $(i+2)^{th}$ shift registers $SR1_{i-2}$ and $SR1_{i+2}$ and accordingly outputs a pre-charge signal PCS when i is greater than or equal to 3 and less than or equal to N−2. In other words, the pre-charge units 310 of the shift registers $SR1_i$, except for the first, the second, the $(N-1)^{th}$ and the $N^{th}$ shift registers, respectively receive scan signals $SS_{i-2}$_L and $SS_{i+2}$_L output by the previous two-stage of shift register $SR1_{i-2}$ and the next two-stage of shift register $SR1_{i+2}$ so as to generate the corresponding pre-charge signal PCS.

On the other hand, referring to FIG. 2A, the first and the second shift registers generate the corresponding pre-charge signal PCS using the start pulse signal STV1_L provided by the timing controller 122. The $(N-1)^{th}$ and the $N^{th}$ shift registers generate the corresponding pre-charge signal PCS using the start pulse signal STV2_L provided by the timing controller 122. It should be specially mentioned that in the present exemplary embodiment, the start pulse signals STV1_L (under the condition of scanning in the forward direction) and STV2_L (under the condition of scanning in the backward direction) is not merely used to generate the corresponding pre-charge signal PCS, and based on another aspect, the start pulse signals STV1_L (under the condition of scanning in the forward direction) and STV2_L (under the condition of scanning in the backward direction) may also pull down a voltage level of the pre-charge signal PCS to a reference potential.

Continuing to refer to FIG. 3, the pull-up unit 320 is coupled to the pre-charge unit 310 and receives the pre-charge signal PCS and a first predetermined clock signal PCK to output a scan signal $SS_i$_L. The pull-down unit 330 is coupled to the pre-charge unit 310 and the pull-up unit 320 and includes a first discharge unit 332 and a second discharge unit 334. The first discharge unit 332 and the second discharge unit 334 receive the pre-charge signal PCS, a first level signal VPWL1 and a second level signal VPWL2 and accordingly determined whether to pull down the scan signal $SS_i$_L to and maintain the scan signal $SS_i$_L in a reference potential Vss (e.g., a negative voltage, but not limited in the invention. The first level signal VPWL1 and the second level signal VPWL2 are reversed to each other, and thus, in the present exemplary embodiment, one of the first discharge unit 332 and the second discharge unit 334 performs a discharge operation to pull down the scan signal $SS_i$_L to and maintain the scan signal $SS_i$_L in the reference potential Vss.

To be more detailed, the timing controller 122 sequentially provides different clock signals CLK1_L through CLK4_L to each of the shift registers $SR1_1$ through $SR1_N$ to serve as the corresponding predetermined clock signals PCK, such that each of the shift registers $SR1_1$ through $SR1_N$ may drive the pixels arranged in odd-numbered columns in the display area AA according to the scanning order along the forward direction or along the backward direction. Waveforms of the start pulse signals STV1_L and STV2_L and the clock signals CLK1_L through CLK4_L provided by the timing controller 122 vary with the driving manner according to the scanning order along the forward direction or along the backward direction (which is apparent with reference to the schematic signal timing diagrams of the embodiments below).

Figure 4:
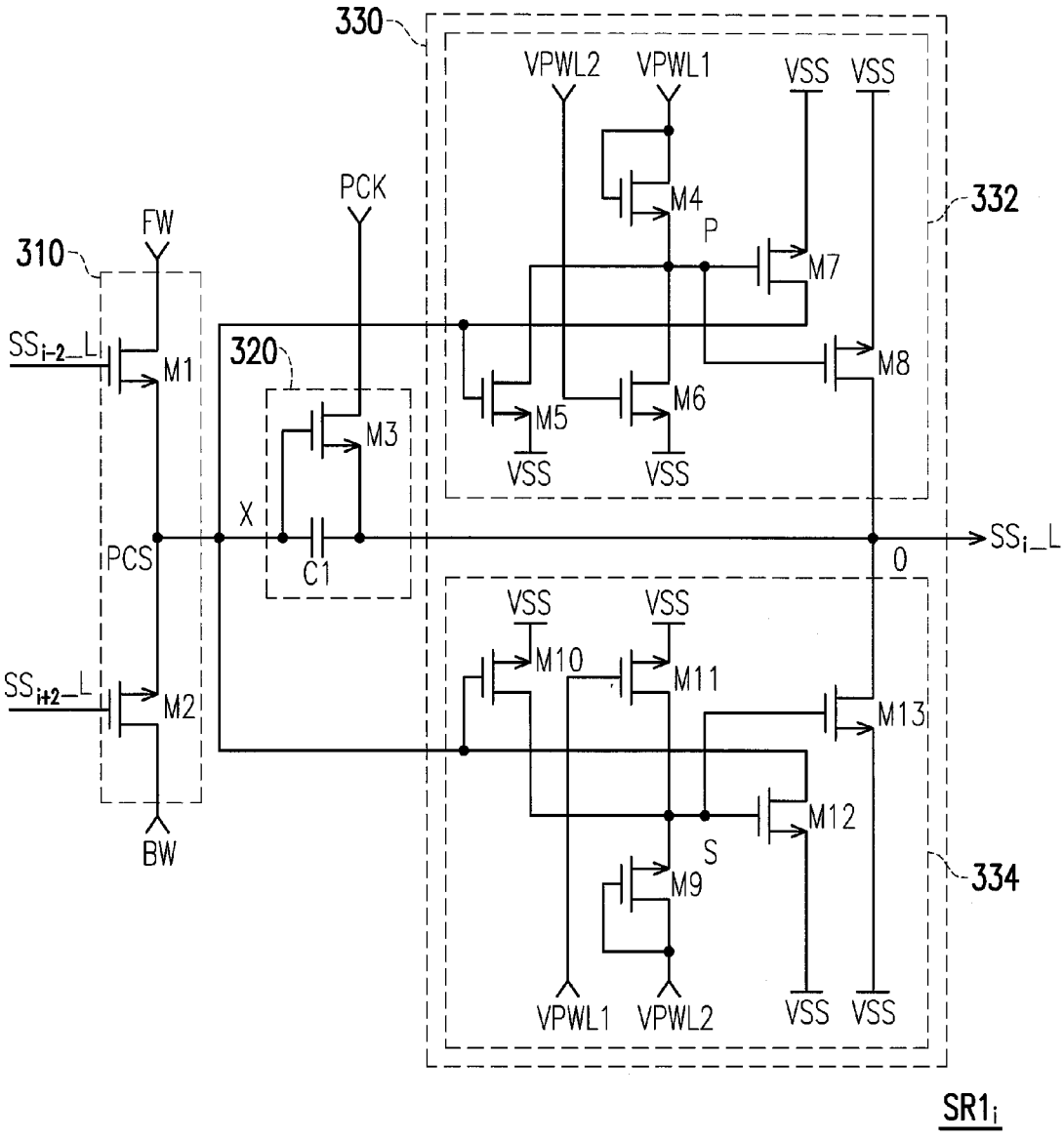
FIG. 4 is a schematic circuit diagram of the shift registers of the embodiment illustrated in FIG. 3.

In order to describe the embodiment illustrated in FIG. 3 more clearly, FIG. 4 is a schematic circuit diagram of the shift registers of the embodiment illustrated in FIG. 3. Referring to FIG. 4, the pre-charge unit 310 includes transistors M1 and M2, the pull-up unit 320 includes a transistor M3 and a capacitor C1, the first discharge unit 332 of the pull-down unit 330 includes transistors M4 through M8, and the second discharge unit 334 of the pull-down unit 330 includes transistors M9 through M13. In this case, each of the transistors M1 through M13 described in the present exemplary embodiment is an N-type transistor, for example, which is not limited in the invention.

In the pre-charge unit 310 of the $i^{th}$ shift register $SR1_i$, a gate of the transistor M1 receives the scan signal $SS_{i-2}$_L (under the condition where i is greater than or equal to 3 or less than or equal to N−2) or the start pulse signal STV1_L (under the condition where i is less than 3) output by the $(i-2)^{th}$ shift register $SR1_{i-2}$, and a drain of the transistor M1 receives the forward input signal FW. A gate of the transistor M2 receives the scan signal $SS_{i+2}$_L (under the condition where i is greater than or equal to 3 or less than or equal to N−2) or the start pulse signal STV2_L (under the condition where i is greater than N−2) output by the $(i+2)^{th}$ shift register $SR1_{i+2}$, a source of the transistor M2 and a source of the transistor M1 are coupled to each other and also coupled in common to a node X to output the pre-charge signal PCS, and a drain of the transistor M2 receives the backward input signal BW.

In the pull-up unit 320 of the $i^{th}$ shift register $SR1_i$, a gate of the transistor M3 receives the pre-charge signal PCS through the node X, a drain of the transistor M3 receives the predetermined clock signal PCK, and a source of the transistor M3 outputs the scan signal $SS_i$_L. A first terminal of the capacitor C1 is coupled to the gate of the transistor M3 and the node X, and a second terminal of the capacitor C1 is coupled to the source of the transistor M3.

In the first discharge unit 332 of the $i^{th}$ shift register $SR1_i$, A gate and a drain of the transistor M4 are coupled with each other to receive the first level signal VPWL1. A gate of the transistor M5 is coupled to the source of the transistor M1 and the source of the transistor M2 to receive the pre-charge signal PCS, a drain of the transistor M5 is coupled to a source of the transistor M4, and a source of the transistor M5 is coupled to the reference potential Vss. A gate of the transistor M6 receives the second level signal VPWL2, a drain of the transistor M6 is coupled to the source of the transistor M4, and a source of the transistor M6 is coupled to the reference potential Vss. A gate of the transistor M7 is coupled to the source of the transistor M4 and the drain of the transistor M6, a drain of the transistor M7 is coupled to the source of the transistor M1 and the source of the transistor M2, and a source of the transistor M7 is coupled to the reference potential Vss. A gate of the transistor M8 is coupled to the gate of the transistor M7, a drain of the transistor M8 is coupled to the source of the transistor M3, and a source of the transistor M8 is coupled to the reference potential Vss.

In the second discharge unit 334 of the $i^{th}$ shift register $SR1_i$, a gate and a drain of the transistor M9 are coupled with each other to receive the second level signal VPWL2. A gate of the transistor M10 is coupled to the source of the transistor M1 and the source of the transistor M2 to receive the pre-charge signal PCS, a drain of the transistor M10 is coupled to a source of the transistor M9, and a source of the transistor M10 is coupled to the reference potential Vss. A gate of the transistor M11 receives the first level signal VPWL1, a drain of the transistor M11 is coupled to the source of the transistor M9, and a source of the transistor M11 is coupled to the reference potential Vss. A gate of the transistor M12 is coupled to the source of the transistor M9 and the drain of the transistor M11, a drain of the transistor M12 is coupled to the source of the transistor M1 and the source of the transistor M2, and a source of the transistor M12 is coupled to the reference potential Vss. A gate of the transistor M13 is coupled to the gate of the transistor M12, a drain of the transistor M13 is coupled to the source of the transistor M3, and a source of the transistor M13 is coupled to the reference potential Vss.

Figure 5A:
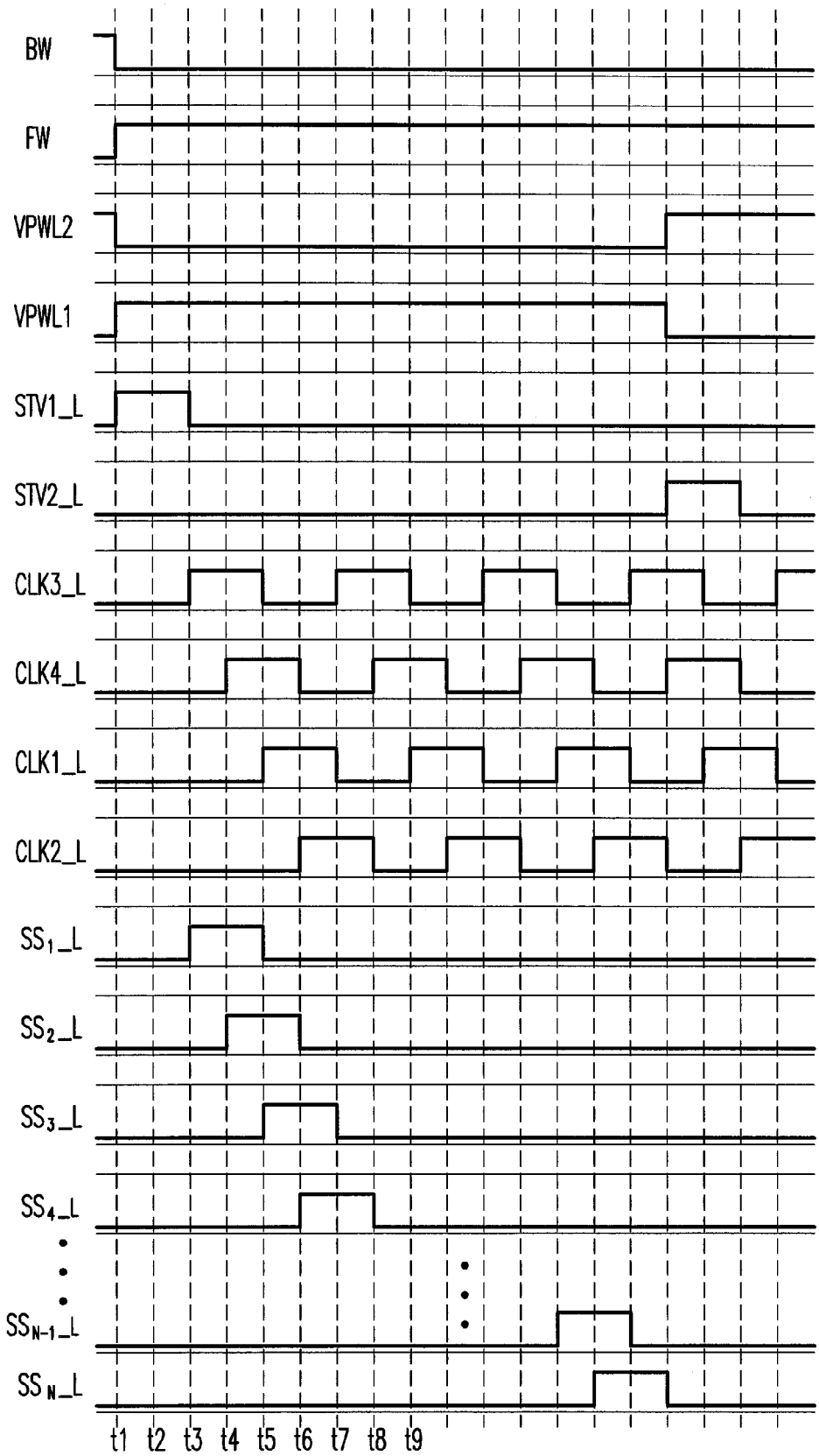
FIG. 5A and FIG. 5B are schematic signal timing diagrams of the bidirectional shift register apparatus according to an embodiment of the invention.

Herein, in order to describe the operation of the shift register $SR1_i$ illustrated in FIG. 4, FIG. 5A schematically illustrates that the bidirectional shift register apparatus 112_L performs scanning on the pixels arranged in odd-numbered columns in the display area AA according to a forward scanning order.

First, referring to FIG. 5A, it is apparent that in the driving state according the forward scanning order, the shift register $SR1_i$ receives the forward input signal FW in a high level and the backward scan signal BW in a low level, and the shift register $SR1_i$ receives the first level signal VPWL1 and second level signal VPWL2 that are reversed to each other. Additionally, the timing controller 122 provides the clock signals CLK3_L, CLK4_L, CLK1_L and CLK2_L which have specific duty cycles but different phases. In the present exemplary embodiment, the duty cycle of each of the clock signals CLK1_L through CLK4_L is, for example, 50%, and the timing controller 122 generates the clock signals CLK1_L through CLK4_L, each of which has a phase falling behind it previous signal for 90 degrees according to an order like CLK3_L→CLK4_L→CLK1_L→CLK2_L. That is, an enable time (i.e., a time for each signal to be raised to a high level which is also a pulse width of each signal) of each of the clock signals CLK3_L, CLK4_L, CLK1_L and CLK2_L overlaps with it previous clock signal by 50%, but the invention is not limited thereto. For instance, the clock signal CLK4_L has a phase falling behind the clock signal CLK3_L and a phase difference of 90 degrees from the clock signal CLK3_L, the clock signal CLK1_L has a phase falling behind the clock signal CLK4_L and a phase difference of 90 degrees from the clock signal CLK4_L, and the clock signal CLK2_L has a phase falling behind the clock signal CLK1_L and a phase difference of 90 degrees from the clock signal CLK1_L.

Moreover, in the present exemplary embodiment, an enable time of a first pulse of the clock signals CLK3_L within a frame period is later than an enable time of the start pulse signal STV1_L and does not overlap with the enable time of the start pulse signal STV1_L. When the start pulse signal STV1_L is converted from being enabled to disabled, the clock signal CLK3_L is enabled. Additionally, an enable time of the start pulse signal STV2_L depends on the value of N and is later than and does not overlap with an enable time of the scan signal $SS_N$_L of the last shift register. When the scan signal $SS_N$_L of the last shift register is converted from being enabled to disabled, the start pulse signal STV2_L is converted from being disabled to enabled. Thus, when the number of N is greater, the time difference between the enable time of the start pulse signal STV1_L and the enable time of the later start signal STV2_L is greater.

Referring to FIG. 2A, FIG. 4 and FIG. 5A altogether, taking the first shift register $SR1_1$ as an example, during a time period from a time t1 to a time t3, the transistor M1 of the pre-charge unit 310 is turned on in response to the enabled start signal STV1_L, and transistor M2 is turned off in response to the disabled scan signal $SS_N$_L, such that the pre-charge unit 310 outputs the corresponding pre-charge signal PCS to charge the node X. During this time period, since the pull-up unit 320 receives the disabled clock signal CLK3_L, the scan signal $SS_1$_L is maintained in the reference potential Vss no matter whether the transistor M3 is turned on by the pre-charge signal PCS.

During a time period from the time t3 to a time t5, the transistors M1 and M2 of the pre-charge unit 310 are turned off respectively in response to the disabled start signal STV1_L and the disabled scan signal $SS_3$_L. The pull-up unit 320 receives the enabled clock signal CLK3_L. During this time period, the node X is pulled up through a coupling effect between the drain and the gate of the transistor M3, such that the transistor M3 is turned on and outputs the scan signal $SS_1$_L in a high level.

On the other hand, the transistor M5 of the first discharge unit 332 is turned on in response to the pre-charge signal PCS received by the gate of the transistor M5. Accordingly, the transistor M5 is turned on by the high level of the node X, and the transistor M6 is turned off in response to the disabled second level signal VPWL2, and thus, a level of a node P is pulled down to a low level due to the transistor M5 being turned on, such that the transistors M7 and M8 are turned off and does not perform the discharge operation on a node O and the node X. Thereby, the first discharge unit 332 does not affect the output of the scan signal $SS_1$_L during the time period from the time t3 to the time t5, such that the scan signal $SS_1$_L is maintained in the high level during the time period from the time t3 to the time t5.

On the other hand, the transistor M9 of the second discharge unit 332 is turned off in response to the disabled second level signal VPWL2, and thus, a node S is maintained in the low level. Additionally, the transistor M10 of the second discharge unit 332 is turned on in response to the pre-charge signal PCS received by the gate thereof, and the transistor M11 is turned on in response to the enabled first level signal VPWL1. The node S is maintained in the low level more stably due to the transistor M10 and the transistor M11 being turned on, such that the transistors M12 and M13 are turned off and does not perform the discharge operation on the node O and the node X. Thereby, the second discharge unit 334 does not affect the output of the scan signal $SS_1$_L during the time period from the time t3 to the time t5, such that the scan signal $SS_1$_L is maintained in the high level during the time period from the time t3 to the time t5.

During a time period from the time t5 to a time t7, the transistor M1 of the pre-charge unit 310 is turned off in response to the disabled start signal STV1_L, and the transistor M2 is turned on in response to the enabled scan signal $SS_3$_L. During this time period, the pre-charge unit 310 discharges the node X through the turned-on transistor M2, such that the low level of the node X cause the transistor M5 to be turned off, and the transistor M6 is turned off in response to the disabled second level signal VPWL2, the enabled first level signal VPWL1 causes the transistor M4 to be turned on, the turned-on transistor M4 causes a voltage of the node P to be pulled up to a level that is approximate to the level of the first level signal VPWL1, such that the transistor M7 and the transistor M8 are turned on by the voltage of the node P. Thereby, the transistors M7 and M8 of the first discharge unit 332 are turned on in response to the voltage of the node P to discharge the node X and the node O respectively. Thus, the scan signal $SS_1$_L may be rapidly pulled down to the reference potential Vss in the time t5 and maintained in the reference potential Vss during the time period from the time t5 to the time t7.

On the other hand, in the same time period from the time t5 to the time t7, the transistor M1 of the pre-charge unit 310 is turned off in response to the disabled start signal STV1_L, and the transistor M2 is turned on in response to the enabled scan signal $SS_3$_L. During this time period, the pre-charge unit 310 discharges the node X through the turned-on transistor M2. Thereby, the low level of the node X causes the transistor M10 to turned off, the transistor M11 is turned on in response to the enabled first level signal VPWL1, and the transistor M9 is turned off in response to the disabled second level signal VPWL2. That is to say, the voltage of the node S is still maintained in the low level, and the transistor M12 and the transistor M13 are not turned on. In other words, the second discharge unit 334 is controlled by the enabled first level signal VPWL1 and the disabled second level signal VPWL2 and thus, does not discharge the node X and the node O. The first level signal VPWL1 and the second level signal VPWL2 are reversed to each other. Accordingly, when the first level signal VPWL1 is high-leveled, the first discharge unit 332 may discharge the node X to pull down/maintain the scan signal SS to/in the reference potential Vss. When the second level signal VPWL2 is high-leveled, the second discharge unit 334 may discharge the node X to pull down/maintain the scan signal $SS_1$_L to/in the reference potential Vss.

Thereafter, during a time period from the time t7 to a time t9, the transistors M1 and M2 of the pre-charge unit 310 are turned off respectively in response to the disabled start signal STV1_L and the disabled scan signal $SS_3$_L. Likewise, the pull-up unit 320 receives the enabled clock signal CLK3_L; however, the transistor M5 of the first discharge unit 332 is not turned on during this time period since the node X is discharged to the reference potential Vss in the previous time period, such that the node O is continuously maintained in the reference potential Vss during the time period from the time t7 to the time t9.

Accordingly, the follow-up operations of the shift register $SR1_i$ during the same frame period after the time t9 may refer to the description with respect to the operations during the time periods from the time t5 to the time t7 from the time t7 to the time t9 and will not be repeated hereinafter. Moreover, although only the operational principle of the $i^{th}$ shift register $SR1_i$ is described in the above embodiment, operational principles of the rest of the shift registers are similar to that of the $i^{th}$ shift register $SR1_i$ and thus, will not be repeated hereinafter.

It should be specially mentioned that during the scanning process according to the forward scanning order, the node X is pre-charged when the gate of the transistor M1 of the shift register $SR1_i$ is turned on when receiving a high-level signal, such that the pull-up unit 320 may output the high-level scan signal $SS_i$_L according to the predetermined clock signals. On the other hand, when the gate of the transistor M2 of the shift register $SR1_i$ is turned on when receiving the high-level signal, the transistor M2 discharges the node X, such that the pull-down unit 330 pull down and maintain the scan signal $SS_1$_L to and in the reference potential according to the first level signal VPWL1 and the second level signal VPWL2.

On such basis, each of the first and the second shift registers does not have the previous-two stage of shift register and can not receive the scan signal of the previous-two stage of shift register for the pre-charge operation. Thus, in the invention, the start pulse signal STV1_L is input to the first and the second shift registers $SR1_1$ and $SR1_2$ respectively to serve as the signal for turning on the first transistor Ms in the first and the second shift registers. By doing so, the first and the second shift registers $SR1_1$ and $SR1_2$ pre-charge the node X respectively when receiving predetermined clock signals CLK3_L and CLK4_L.

Additionally, under the condition of scanning along the forward direction, each of the $(N-1)^{th}$ and the $N^{th}$ shift registers does not have the later second shift register and can not receive the scan signal of the later second shift register for the discharge operation. Thus, in the invention, the start pulse signal STV2_L is input to the $(N-1)^{th}$ and the $N^{th}$ shift registers respectively to serve as signal the for turning on the transistor M2 of the $(N-1)^{th}$ and the $N^{th}$ shift register. By doing so, the $(N-1)^{th}$ and the $N^{th}$ shift register discharge the node X respectively when receiving the start pulse signal STV2_L. Thus, the scan signals SS1_L through SSN_L of all the shift registers $SS1_1$ through $SS1_N$ have only one pulse in a frame period, and scan signals SS1_L through SSN_L of all the shift registers $SS1_1$ through $SS1_N$ may serve as the scan signal for driving the pixels. In other words, the bidirectional shift register apparatus 112_L can normally drive the pixels arranged in each of odd-numbered columns in the display area without disposing any dummy shift register.

Figure 6A:
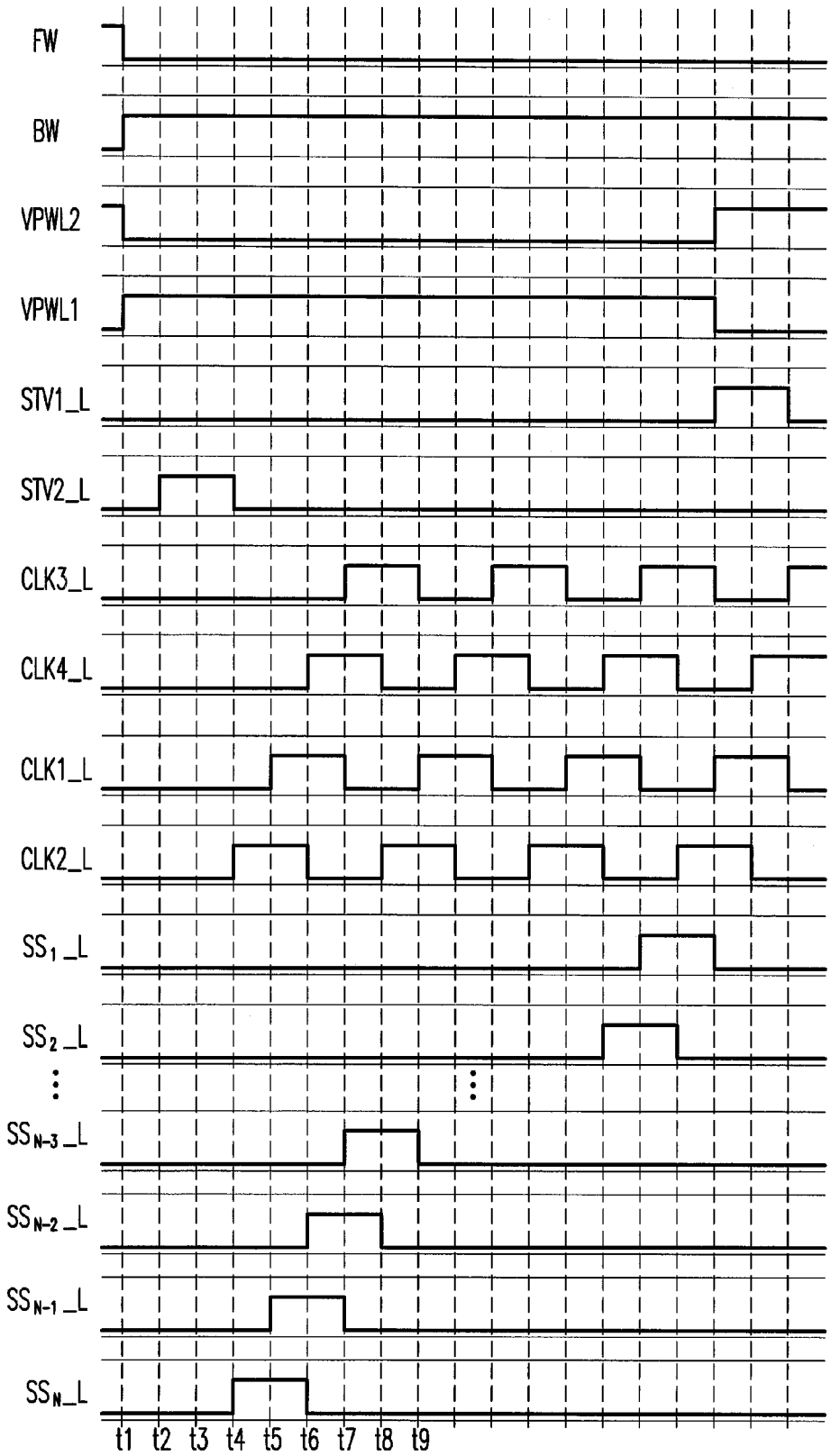
FIG. 6A and FIG. 6B are signal timing diagrams of the bidirectional shift register apparatus according to another embodiment of the invention.

On the other hand, under the condition of scanning along the backward direction, each of the shift registers $SR1_1$ through $SR1_N$ receives the high-level backward scan signal BW and the low-level forward input signal FW, and the shift register $SR1_i$ receives the first level signal VPWL1 and the second level signal VPWL2 that are reversed to each other. Waveforms of the start pulse signals STV1_L and STV2_L and the clock signals CLK1_L through CLK4_L provided by the timing controller 122 may be as illustrated in FIG. 6A. The embodiment illustrated in FIG. 6A is different from that illustrated in FIG. 5A in that the timing controller 122 generates the clock signals CLK1_L through CLK4_L (which are generated according to the order like CLK3_L→CLK4_L→CLK1_L→CLK2_L under the condition of scanning along the forward direction), each of which has a phase falling behind it previous signal for 90 degrees according to an order like CLK2_L→CLK1_L→CLK4_L→CLK3_L.

Moreover, in the present exemplary embodiment, the enable time of a first pulse of the start pulse signal STV2_L within a frame period is earlier than the enable time of the start pulse signal STV1_L and does not overlap with the enable time of the start pulse signal STV1_L. When the start pulse signal STV2_L is converted from being enabled to disabled, the clock signal CLK2_L is enabled. Additionally, the enable time of the start pulse signal STV1_L depends on the value of N, is later than and does not overlap with the enable time of the scan signal $SS_1$_L of the first shift register. Thus, when the value of N is greater, the enable time of the start pulse signal STV1_L is later than the enable time of the start pulse signal STV2_L for longer.

Furthermore, under the condition where the shift register $SR1_1$ through $SR1_N$ are in the driving state according to the backward scanning order, taking the shift registers $SR_N$ through $SR_{N-3}$ for example, the shift registers $SR_N$, $SR_{N-1}$, $SR_{N-2}$ and $SR_{N-3}$ sequentially serve the clock signals CLK2_L, CLK1_L, CLK4_L and CLK3_L as the predetermined clock signals PCK. It should be noted that the order of the shift register $SR1_1$ through $SR1_N$ as illustrated is defined according to the order when performing the forward scanning operation (from top to bottom), but the invention is not limited thereto. In other words, in the driving manner of scanning along the backward direction, the order of the shift registers $SR1_1$ through $SR1_N$ may also be defined according to according to the order when performing the backward scanning operation (from bottom to top), such as the shift register $SR1_N$, $SR1_{N-1}$, . . . , $SR1_1$ illustrated in FIG. 2A may be defined as the first, the second through the $N^{th}$ shift registers.

Figure 5B:
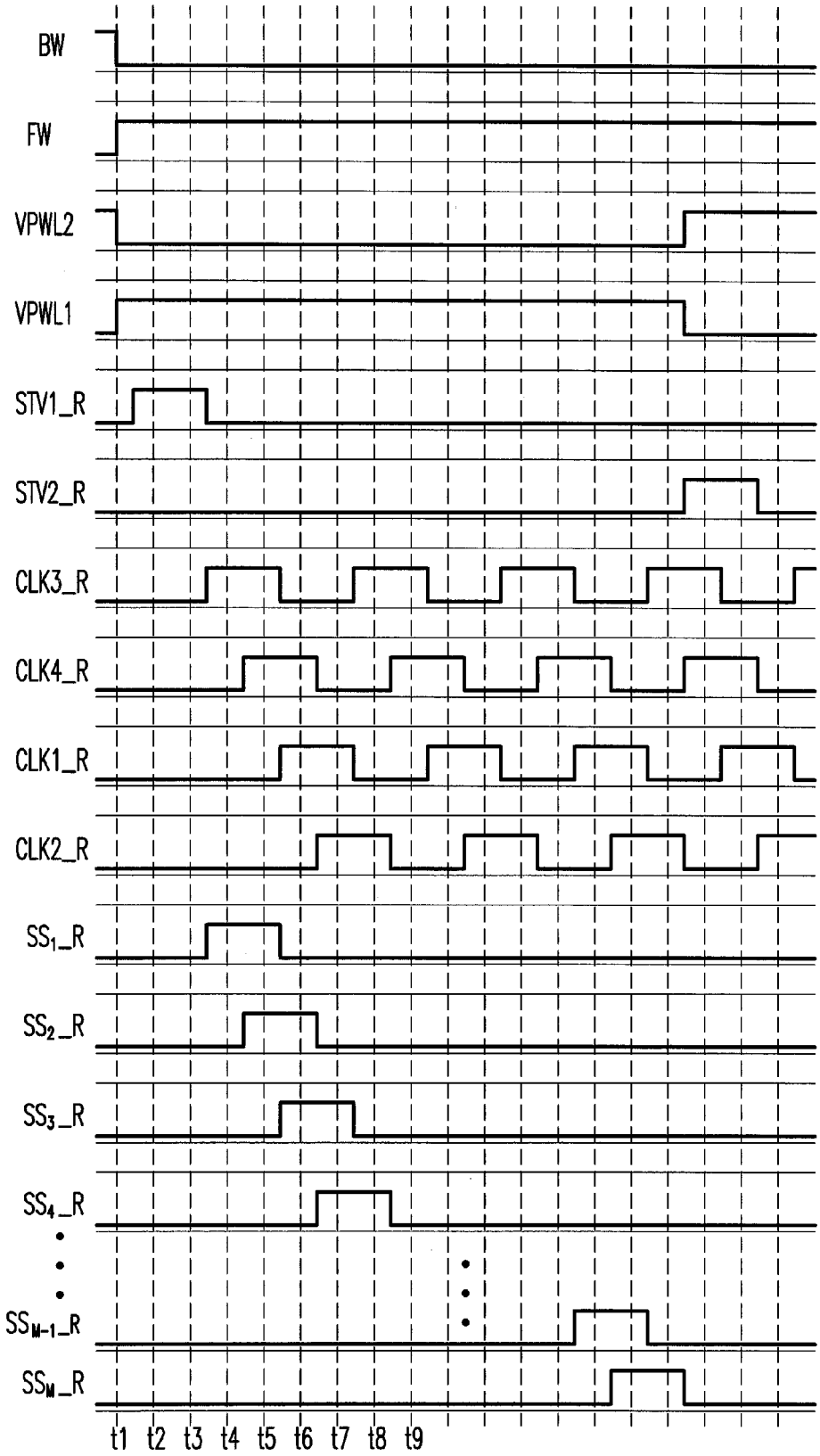
Figure 6B:
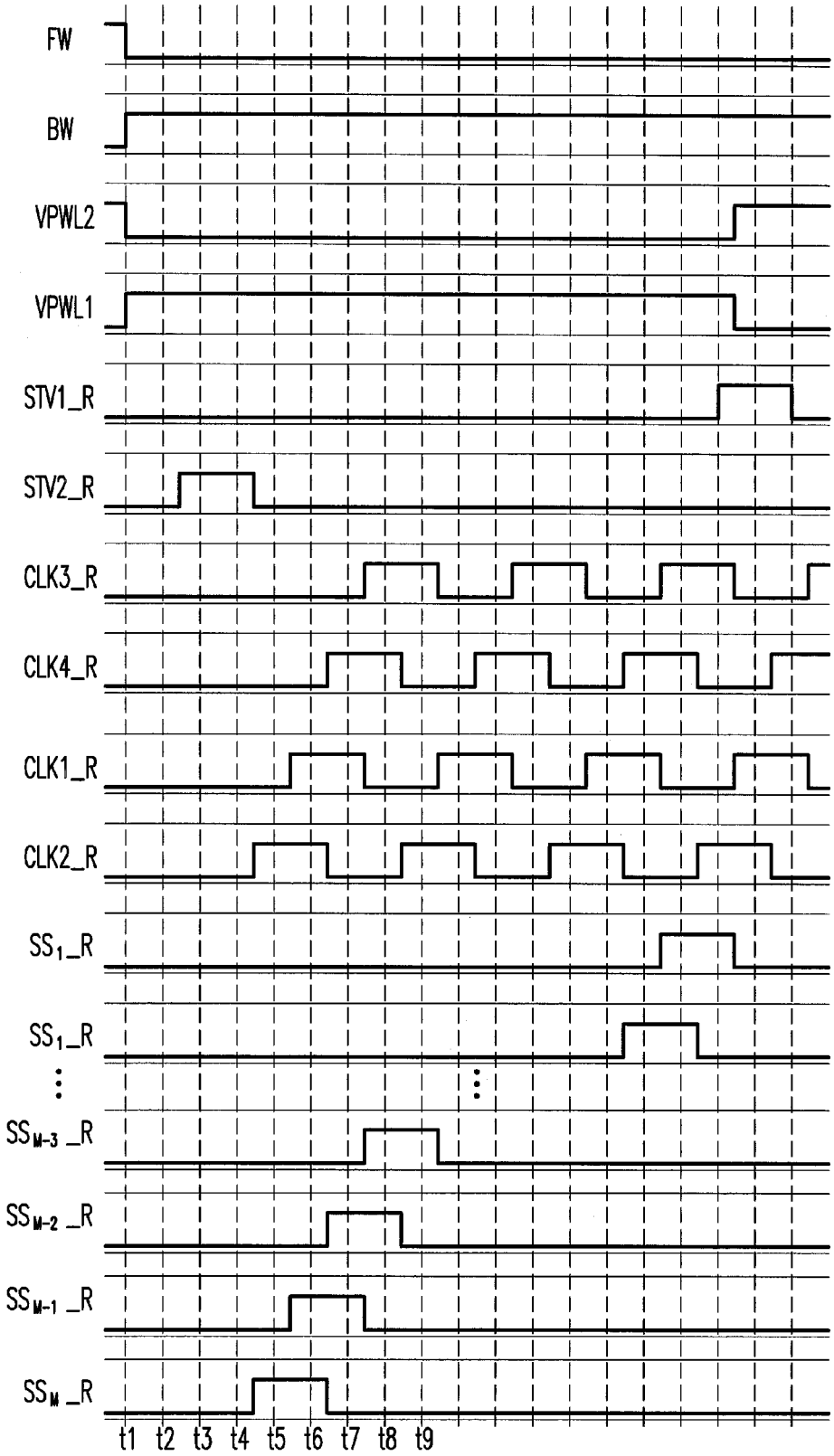

On the other hand, FIG. 5B and FIG. 6B respectively illustrates that the signal waveforms when the bidirectional shift register apparatus 112_R is driven according to the forward scanning order and the backward scanning order. Referring FIG. 2B together with FIG. 5B, in the present exemplary embodiment, the bidirectional shift register apparatus 112_R and the shift registers $SR2_1$ through $SR2_M$ thereof have the same structures and operational principles as those of the bidirectional shift register apparatus 112_L, and the bidirectional shift register apparatuses 112_L and 112_R are different from each other only in that bidirectional shift register apparatus 112_R sequentially drives the pixels arranged in even-numbered columns in the display area AA according to the start pulse signals STV1_R and STV2_R and the clock signals CLK1_R through CLK4_R.

To be more detailed, simultaneously referring to FIG. 5A and FIG. 5B, in the driving state according the forward scanning order, the start pulse signals STV1_R and STV2_R respectively correspond to the start pulse signals STV1_L and STV2_L, which are different only in that a phases of each of the start pulse signals STV1_R and STV2_R falls behind that of each of the start pulse signals STV1_L and STV2_L and has a phase difference of 45 degrees therefrom. Namely, the enable time of the start pulse signals STV1_L and STV1_R may overlap with each other by 75%, and the enable time of the start pulse signals STV2_L and STV2_R may also overlap with each other by 75%. Similarly, the clock signals CLK1_R through CLK4_R respectively correspond to the clock signals CLK1_L through CLK4_L, which are different only in that a phase of each of the clock signals CLK1_R through CLK4_R that of each of the clock signals CLK1_L through CLK4_L and has a phase difference of 45 degrees therefrom. Namely, the enable time of the clock signals CLK1_L through CLK4_L and the corresponding clock signals CLK1_R through CLK4_R may overlap with each other by 75%. Based on the aforementioned timing difference among the signals, the bidirectional shift register apparatus 112R may sequentially generate the scan signals SS1_R through SSM_R respectively having certain phase difference from the scan signals SS1_L through SSN_L for driving the pixels arranged in even-numbered columns, such that the adjacent pixels in each column are sequentially turned on according to a specific time interval (e.g., a half of the time interval from the time t1 to the time t2).

In view of the foregoing, the invention provides an LCD and bidirectional shift register apparatuses thereof. In the bidirectional shift register apparatuses, the disposition of dummy shift registers in the bidirectional shift register apparatus can be omitted utilizing the start pulse signals, such that the issue that the threshold voltages of the transistors in the dummy shift registers are rapidly increased due to the stress effect can be prevented. Thereby, no abnormal operation will occur like that occurring in the dummy shift registers to improve the reliability of the bidirectional shift register apparatuses. Moreover, since the transistor elements of the shift registers of the invention does not have the dummy shift register, the area of the circuit layout of the bidirectional shift register apparatuses can be further reduced.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A bidirectional shift register apparatus, comprising: N shift registers, collected in series, and an $i^{th}$ shift register of the N shift registers comprising:

a pre-charge unit, receiving outputs of an $(i-2)^{th}$ and an $(i+2)^{th}$ shift registers to output a pre-charge signal when i is greater than or equal to 3 and less than or equal to N−2, wherein the pre-charge unit receives a first start pulse signal and the output of the $(i+2)^{th}$ shift register to output the pre-charge signal when i is equal to 1 or 2 and receives a second start pulse signal and the output of the $(i-2)^{th}$ shift register to output the pre-charge signal when i is equal to (N−1) or N, wherein i is a predetermined positive integer, and wherein N is a predetermined positive integer;

a pull-up unit, coupled to the pre-charge unit and receiving the pre-charge signal and a predetermined clock signal to output a scan signal; and a pull-down unit, coupled to the pre-charge unit and the pull-up unit, receiving the pre-charge signal, a first level signal and a second level signal to control a level of the scan signal.

2. The bidirectional shift register apparatus according to claim 1, wherein the pre-charge unit further receives a forward input signal and a backward input signal, the bidirectional shift register apparatus outputs the scan signals according to the forward input signal and the backward input signal.

3. The bidirectional shift register apparatus according to claim 2, wherein the pre-charge unit comprises:

a first transistor, having a first source/drain receiving the forward input signal, a second source/drain outputting the pre-charge signal and a gate receiving the scan signal output by the $(i-2)^{th}$ shift register when i is a positive integer that is greater than or equal to 3 and less than or equal to N and receiving the first start pulse signal when i is equal to 1 or 2; and a second transistor, having a first source/drain coupled to the second source/drain of the first transistor, a second source/drain receiving the backward input signal and a gate receiving the scan signal output by the $(i+2)^{th}$ shift register when i is greater than or equal to 1 and less than or equal to N−2 and receiving the second start pulse signal when i is equal to (N−1) or N.

4. The bidirectional shift register apparatus according to claim 3, wherein the pull-up unit comprises:

a third transistor, having a gate receiving the pre-charge signal, a first source/drain receiving the predetermined clock signal and a second source/drain outputting the scan signal; and a first capacitor, having a first terminal coupled to the gate of the third transistor and a second terminal coupled to the second source/drain of the third transistor, wherein the pull-down unit comprises:

a first discharge unit, receiving the pre-charge signal, the first level signal and the second level signal so as to determine whether to pull down the scan signal to a reference potential; and a second discharge unit, receiving the pre-charge signal, the first level signal and the second level signal so as to determine whether to maintain the scan signal in the reference potential, wherein the first and the second level signals are reversed to each other.

5. The bidirectional shift register apparatus according to claim 4, wherein the first discharge unit comprises:

a fourth transistor, having a gate and a first source/drain coupled with each other to receive the first level signal;

a fifth transistor, having a gate coupled to the second source/drain of the first transistor and the first source/drain of the second transistor to receive the pre-charge signal, a first source/drain coupled to the second source/drain of the fourth transistor and a second source/drain coupled to the reference potential;

a sixth transistor, having a gate receiving the second level signal, a first source/drain coupled to the second source/drain of the fourth transistor and a second source/drain coupled to the reference potential;

a seventh transistor, having a gate coupled to the second source/drain of the fourth transistor and the first source/drain of the sixth transistor, a first source/drain coupled to the second source/drain of the first transistor and the first source/drain of the second transistor and a second source/drain coupled to the reference potential; and an eighth transistor, having a gate coupled to the gate of the seventh transistor, a first source/drain coupled to the second source/drain of the third transistor and a second source/drain coupled to the reference potential, wherein the second discharge unit comprises:

a ninth transistor, having a gate and a first source/drain coupled with each other to receive the second level signal;

a tenth transistor, having a gate coupled to the second source/drain of the first transistor and the first source/drain of the second transistor to receive the pre-charge signal, a first source/drain coupled to the second source/drain of the ninth transistor and a second source/drain coupled to the reference potential;

an eleventh transistor, having a gate receiving the first level signal, a first source/drain coupled to the second source/drain of the ninth transistor and a second source/drain coupled to the reference potential;

a twelfth transistor, having a gate coupled to the second source/drain of the ninth transistor and the first source/drain of the eleventh transistor, a first source/drain coupled to the second source/drain of the first transistor and the first source/drain of the second transistor and a second source/drain coupled to the reference potential; and a thirteenth transistor, having a gate coupled to the gate of the twelfth transistor, a first source/drain coupled to the second source/drain of the third transistor and a second source/drain coupled to reference potential.

6. A liquid crystal display (LCD), comprising: an LCD panel, comprising a substrate, a plurality of pixels arranged in an array, a first bidirectional shift register apparatus and a second bidirectional shift register apparatus, wherein the pixels, the first bidirectional shift register apparatus and the second bidirectional shift register apparatus are disposed on the substrate, wherein the first bidirectional shift register apparatus has N first shift registers collected in series and respectively corresponding to the pixels arranged in odd-numbered columns, and an ith first shift register comprises:

a first pre-charge unit, receiving outputs of an (i−2)th and an (i+2)th first shift registers to output a first pre-charge signal when i is greater than or equal to 3 and less than or equal to N−2, wherein i is a predetermined positive integer, and wherein N is a predetermined positive integer, wherein the first pre-charge unit receives a first start pulse signal and the output of the (i+2)th first shift register to output the first pre-charge signal when i is equal to 1 or 2 and receives a second start pulse signal and the output of the (i−2)m first shift register to output the first pre-charge signal when i is equal to (N−I) or N;

a first pull-up unit, coupled to the first pre-charge unit and receiving the first pre-charge signal and a first predetermined clock signal to output a first scan signal; and a first pull-down unit, coupled to the first pre-charge unit and the first pull-up unit and receiving the first pre-charge signal, a first level signal and a second level signal to control a level of the first scan signal, wherein the second bidirectional shift register apparatus has M second shift registers connected in series and respectively corresponding to the pixels arranged in even-numbered columns, and a jth second shift register comprises:

a second pre-charge unit, receiving outputs of an (j−2)th and an (j+2)th second shift registers so as to output a second pre-charge signal when j is a positive integer which is greater than or equal to 3 and less than or equal to M−2, wherein M is a predetermined positive integer, wherein the second pre-charge unit receives a third start pulse signal and the output of the (j+2)th second shift register to output the second pre-charge signal when j is equal to 1 or 2 and receives a fourth start pulse signal and the output of the (j−2)th second shift register to output the second pre-charge signal when j is equal to (M−I) or M; and a second pull-up unit, coupled to the second pre-charge unit and receiving the second pre-charge signal and a second predetermined clock signal to output a second scan signal; and a second pull-down unit, coupled to the second pre-charge unit and the second pull-up unit and receiving the second pre-charge signal, a third level signal and a fourth level signal to control a level of the second scan signal; and a driving circuit, coupled to the LCD panel, configured to drive the LCD panel to display an image and providing a plurality of predetermined clock signals to serve as the first predetermined clock signal and the second predetermined clock signal; and a backlight module, configured to provide a light source for the LCD panel.

7. The LCD according to claim 6, wherein the first pre-charge unit of each of the first shift registers and the second pre-charge unit of each of the second shift registers further receive a forward input signal and a backward input signal, the first bidirectional shift register apparatus and the second bidirectional shift register apparatus output the first scan signals and the second scan signals sequentially in a first order or a second order that is different from the first order according to the forward input signal and the backward input signal.

8. The LCD according to claim 7, wherein the first pre-charge unit of the ith first shift register comprises:

a first transistor, having a first source/drain receiving the forward input signal, a second source/drain outputting the first pre-charge signal and a gate receiving the first scan signal output by the (i−2)th first shift register when i is a positive integer that is greater than or equal to 3 and less than or equal to N and receiving the first start pulse signal when i is equal to 1 or 2; and;

a second transistor, having a first source/drain coupled to the second source/drain of the first transistor, a second source/drain receiving the backward input signal and a gate receiving the first scan signal output by the (i+2)th first shift register when i is greater than or equal to 1 and less than or equal to N−2 and receiving the second start pulse signal when i is equal to (N−I) or N, wherein the second pre-charge unit of the jth second shift register comprises:

a third transistor, having a first source/drain receiving the forward input signal, a second source/drain outputting the second pre-charge signal and a gate receiving the second scan signal output by the (j−2)th second shift register when j is a positive integer that is greater than or equal to 3 and less than or equal to M and receiving the third staid pulse signal when j is equal to 1 or 2; and;

a fourth transistor, having a first source/drain coupled to the second source/drain of the third transistor, a second source/drain receiving the backward input signal and a gate receiving the second scan signal output by the (j+2) th second shift register when j is greater than or equal to 1 and less than or equal to M−2 and receiving the fourth start pulse signal when j is equal to (M−I) or M.

9. The LCD according to claim 8, wherein the first pull-up unit of the $i^{th}$ first shift register comprises:

a fifth transistor, having a gate receiving the first pre-charge signal, a first source/drain receiving the first predetermined clock signal and a second source/drain outputting the first scan signal; and a first capacitor, having a first terminal coupled to the gate of the fifth transistor and a second terminal coupled to the second source/drain of the fifth transistor, wherein the first pull-down unit of the $i^{th}$ first shift register comprises:

a first discharge unit, receiving the first pre-charge signal, a first level signal and a second level signal so as to determine whether to pull down the first scan signal to a reference potential and comprising:

a sixth transistor, having a gate and a first source/drain coupled with each other to receive the first level signal;

a seventh transistor, having a gate coupled to the second source/drain of the first transistor and the first source/drain of the second transistor to receive the first pre-charge signal, a first source/drain coupled to the second source/drain of the sixth transistor and a second source/drain coupled to the reference potential;

an eighth transistor, having a gate receiving the second level signal, a first source/drain coupled to the second source/drain of the sixth transistor and a second source/drain coupled to the reference potential;

a ninth transistor, having a gate coupled to the second source/drain of the sixth transistor and the first source/drain of the eighth transistor, a first source/drain coupled to the second source/drain of the first transistor and the first source/drain of the second transistor and a second source/drain coupled to the reference potential; and a tenth transistor; having a gate coupled to the gate of the ninth transistor, a first source/drain coupled to the second source/drain of the fifth transistor and a second source/drain coupled to the reference potential; and a second discharge unit, receiving the first pre-charge signal, the first level signal and the second level signal so as to determine whether to maintain the first scan signal in the reference potential, wherein the first and the second level signals are reversed to each other, and comprising:

an eleventh transistor, having a gate and a first source/drain coupled with each other to receive the second level signal;

a twelfth transistor, having a gate coupled to the second source/drain of the first transistor and the first source/drain of the second transistor to receive the first pre-charge signal, a first source/drain coupled to the second source/drain of the eleventh transistor and a second source/drain coupled to the reference potential;

a thirteenth transistor, having a gate receiving the first level signal, a first source/drain coupled to the second source/drain of the eleventh transistor and a second source/drain coupled to the reference potential;

a fourteenth transistor, having a gate coupled to the second source/drain of the eleventh transistor and the first source/drain of the thirteenth transistor, a first source/drain coupled to the second source/drain of the first transistor and the first source/drain of the second transistor and a second source/drain coupled to the reference potential; and a fifteenth transistor, having a gate coupled to the gate of the fourteenth transistor, a first source/drain coupled to the second source/drain of the fifth transistor and a second source/drain coupled to the reference potential.

10. The LCD according to claim 9, wherein the second pull-up unit of the $j^{th}$ second shift register comprises:

a sixteenth transistor, having a gate receiving the second pre-charge signal, a first source/drain receiving the second predetermined clock signal and a second source/drain outputting the second scan signal; and a second capacitor, having a first terminal coupled to the gate of the sixteenth transistor and a second terminal coupled to the second source/drain of the sixteenth transistor, wherein the second pull-down unit of the $j^{th}$ second shift register comprises:

a third discharge unit, receiving the second pre-charge signal, a third level signal and a fourth level signal so as to determine whether to pull down the second scan signal to a reference potential and comprising:

a seventeenth transistor, having a gate and a first source/drain coupled with each other to receive the third level signal;

a eighteenth transistor, having a gate coupled to the second source/drain of the fourteenth transistor and the first source/drain of the fifteenth transistor to receive the second pre-charge signal, a first source/drain coupled to the second source/drain of the seventeenth transistor and a second source/drain coupled to the reference potential;

an nineteenth transistor, having a gate receiving the fourth level signal, a first source/drain coupled to the second source/drain of the seventeenth transistor and a second source/drain coupled to the reference potential;

a twentieth transistor, having a gate coupled to the second source/drain of the seventeenth transistor and the first source/drain of the nineteenth transistor, a first source/drain coupled to the second source/drain of the fourteenth transistor and the first source/drain of the fifteenth transistor and a second source/drain coupled to the reference potential; and a twenty-first transistor; having a gate coupled to the gate of the twentieth transistor, a first source/drain coupled to the second source/drain of the sixteenth transistor and a second source/drain coupled to the reference potential; and a fourth discharge unit, receiving the second pre-charge signal, the third level signal and the fourth level signal so as to determine whether to maintain the second scan signal in the reference potential, wherein the third and the fourth level signals are reversed to each other, and comprising:

a twenty-second transistor, having a gate and a first source/drain coupled with each other to receive the fourth level signal;

a twenty-third transistor, having a gate coupled to the second source/drain of the fourteenth transistor and the first source/drain of the fifteenth transistor to receive the second pre-charge signal, a first source/drain coupled to the second source/drain of the twenty-second transistor and a second source/drain coupled to the reference potential;

a twenty-fourth transistor, having a gate receiving the third level signal, a first source/drain coupled to the twenty-second source/drain of the eleventh transistor and a second source/drain coupled to the reference potential;

a twenty-fifth transistor, having a gate coupled to the second source/drain of the twenty-second transistor and the first source/drain of the twenty-fourth transistor, a first source/drain coupled to the second source/drain of the fourteenth transistor and the first source/drain of the fifteenth transistor and a second source/drain coupled to the reference potential; and a twenty-sixth transistor, having a gate coupled to the gate of the twenty-fifth transistor, a first source/drain coupled to the second source/drain of the sixteenth transistor and a second source/drain coupled to the reference potential.

* * * * *